US009719651B2

(12) United States Patent
Naganawa

(10) Patent No.: US 9,719,651 B2
(45) Date of Patent: Aug. 1, 2017

(54) VEHICLE LAMP

(71) Applicant: KOITO MANUFACTURING CO., LTD., Minato-ku, Tokyo (JP)

(72) Inventor: Masahito Naganawa, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 8 days.

(21) Appl. No.: 14/867,565

(22) Filed: Sep. 28, 2015

(65) Prior Publication Data

US 2016/0091161 A1 Mar. 31, 2016

(30) Foreign Application Priority Data

Sep. 29, 2014 (JP) ..... 2014-198773

(51) Int. Cl.
*F21S 8/10* (2006.01)

(52) U.S. Cl.
CPC ..... *F21S 48/1388* (2013.01); *F21S 48/1104* (2013.01); *F21S 48/1159* (2013.01); *F21S 48/1225* (2013.01); *F21S 48/1323* (2013.01); *F21S 48/1705* (2013.01); *F21S 48/1747* (2013.01)

(58) Field of Classification Search
CPC ..... F21S 48/1388; F21S 48/1323; F21S 48/1225; F21S 48/1104; F21S 48/1159; F21S 48/1747; F21S 48/1705
See application file for complete search history.

(56) References Cited

U.S. PATENT DOCUMENTS

| | | | |
|---|---|---|---|
| 2004/0120158 A1 | 6/2004 | Tatsukawa et al. | |
| 2007/0279924 A1 | 12/2007 | Yagi | |
| 2010/0194276 A1 | 8/2010 | Okubo et al. | |
| 2013/0135889 A1 | 5/2013 | Okubo | |

FOREIGN PATENT DOCUMENTS

| | | | |
|---|---|---|---|
| CN | 1487232 A | 4/2004 | |
| CN | 101082398 A | 12/2007 | |
| CN | 101793372 A | 8/2010 | |
| CN | 102418894 A | 4/2012 | |
| CN | 103133960 A | 6/2013 | |
| DE | EP 2431657 A2 * | 3/2012 | ..... F21S 48/1104 |
| JP | 2014-007106 A | 1/2014 | |

OTHER PUBLICATIONS

Communication dated May 27, 2017, issued by the Chinese Patent Office in counterpart Chinese Application No. 201510622870.7.

* cited by examiner

*Primary Examiner* — David V Bruce
(74) *Attorney, Agent, or Firm* — Sughrue Mion, PLLC

(57) ABSTRACT

A vehicle lamp is configured to selectively perform low beam irradiation and high beam irradiation, and includes at least two reflector units each including a first light emitting element and a second light emitting element disposed next to each other in a front-rear direction and a reflector that reflects emitted light beams from the first light emitting element and the second light emitting element forward. In the vehicle lamp, a low-beam light distribution pattern or part of the low-beam light distribution pattern is formed by simultaneously turning on the first light emitting element of each of the reflector units, and a high-beam light distribution pattern or part of the high-beam light distribution pattern is formed by simultaneously turning on the second light emitting element of each of the reflector units.

3 Claims, 8 Drawing Sheets

VEHICLE LAMP

INCORPORATION BY REFERENCE

The disclosure of Japanese Patent Application No. 2014-198773 filed on Sep. 29, 2014 including the specification, drawings and abstract is incorporated herein by reference in its entirety.

BACKGROUND OF THE INVENTION

1. Field of the Invention

The invention of the present application relates to a vehicle lamp configured to selectively perform low beam irradiation and high beam irradiation.

2. Description of Related Art

Conventionally, a vehicle lamp configured to selectively perform low beam irradiation and high beam irradiation by reflecting a light beam from a light emitting element forward using a reflector is available.

As the vehicle lamp thus configured, Japanese Patent Application Publication No. 2014-7106 (JP 2014-7106 A) describes a vehicle lamp in which six reflector units each including the light emitting element and the reflector are disposed side by side.

In the vehicle lamp described in JP 2014-7106 A, a low-beam light distribution pattern is formed by simultaneously turning on the light emitting elements of four reflector units, and a high-beam light distribution pattern is formed by additionally turning on the light emitting elements of the remaining two reflector units.

In the vehicle lamp described in JP 2014-7106 A, a plurality of the reflector units for the low beam irradiation and a plurality of the reflector units for the high beam irradiation are provided, and hence a problem arises in that the size of the vehicle lamp may be increased.

SUMMARY OF THE INVENTION

The invention provides the vehicle lamp that is configured to selectively perform the low beam irradiation and the high beam irradiation by reflecting the light beam from the light emitting element forward using the reflector and that is capable of forming desired light distribution patterns with a compact configuration.

An aspect of the invention relates to a vehicle lamp configured to selectively perform low beam irradiation and high beam irradiation. The vehicle lamp includes at least two reflector units each including a first light emitting element and a second light emitting element disposed next to each other in a front-rear direction and a reflector that reflects emitted light beams from the first light emitting element and the second light emitting element forward. In the vehicle lamp, a low-beam light distribution pattern or part of the low-beam light distribution pattern is formed by simultaneously turning on the first light emitting element of each of the reflector units, and a high-beam light distribution pattern or part of the high-beam light distribution pattern is formed by simultaneously turning on the second light emitting element of each of the reflector units.

As shown in the above configuration, the vehicle lamp according to the aspect of the invention is configured to form the low-beam light distribution pattern or part of the low-beam light distribution pattern by simultaneously turning on the first light emitting elements of at least two reflector units, and form the high-beam light distribution pattern or part of the high-beam light distribution pattern by simultaneously turning on the second light emitting elements thereof. With this, as compared with a conventional configuration in which a plurality of reflector units for the low beam irradiation and a plurality of reflector units for the high beam irradiation are disposed, it is possible to reduce the number of required reflector units, and thereby reduce the size of the vehicle lamp.

Thus, according to the aspect of the invention, in the vehicle lamp configured to selectively perform the low beam irradiation and the high beam irradiation by reflecting the light beam from the light emitting element forward using the reflector, it is possible to form required light distribution patterns with a compact configuration.

In addition, by adopting the configuration of the aspect of the invention, it becomes possible to achieve a reduction in cost by the reduction in the number of required reflector units.

The first light emitting element and the second light emitting element may be disposed in a state in which light emitting surfaces face downward and the second light emitting element is positioned forward of the first light emitting element in each of the reflector units. According to the above configuration, it is possible to prevent a direct light beam from the first light emitting element from being projected obliquely upward and forward. With this, it is possible to prevent the occurrence of glare light.

At least one of the at least two reflector units may include a diffusing lens that diffuses light beam emitted from the first light emitting element of the reflector unit in a right-left direction to cause light beam after diffusion to enter the reflector of the reflector unit.

In the case where the reflective surface of the reflector is configured such that a high luminous intensity area of the high-beam light distribution pattern is formed by turning on the second light emitting element in a given reflector unit, a high luminous intensity area is formed also in the low-beam light distribution pattern when the first light emitting element thereof is turned on. However, there is a possibility that the high luminous intensity area becomes extremely bright as the low-beam light distribution pattern and light unevenness occurs in the low-beam light distribution pattern.

In such a case, with the configuration in which the diffusing lens is used such that the emitted light beam from the first light emitting element is diffused in the right-left direction and then entered the reflector, it is possible to form a light distribution pattern that spreads in a horizontal direction using a reflected light beam from the reflector. As a result, it is possible to prevent the high luminous intensity area of the low-beam light distribution pattern from becoming extremely bright to thereby cause the light unevenness in the low-beam light distribution pattern.

A distance between a light emitting surface of the first light emitting element and a light emitting surface of the second light emitting element may be set to a value equal to or smaller than 0.3 mm in each of the reflector units.

The light distribution pattern formed by turning on the second light emitting element is displaced upward relative to the light distribution pattern formed by turning on the first light emitting element. In the case where the distance between the light emitting surface of the first light emitting element and the light emitting surface of the second light emitting element is extremely long, when the light distribution pattern formed by turning on the first light emitting element is formed at a position suitable for the formation of the low-beam light distribution pattern, the light distribution pattern formed by turning on the second light emitting element is formed at a position displaced upward from a position suitable for the formation of the high-beam light distribution pattern.

To cope with this, by setting the distance between the light emitting surface of the first light emitting element and the light emitting surface of the second light emitting element to a value equal to or smaller than 0.3 mm, it is possible to form the light distribution pattern formed by turning on the first light emitting element at the position suitable for the formation of the low-beam light distribution pattern and then form the light distribution pattern formed by turning on the second light emitting element at the position suitable for the formation of the high-beam light distribution pattern.

A distance between a light emitting surface of the first light emitting element and a light emitting surface of the second light emitting element may be set to a value equal to or smaller than ⅕ of a width of the light emitting surface of the second light emitting element in the front-rear direction in each of the reflector units. According to the above configuration, it is possible to form the light distribution pattern formed by turning on the second light emitting element at the position suitable for the formation of the high-beam light distribution pattern.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIGS. 7A and 7B are perspective views showing light distribution patterns formed by an irradiation light beam from the vehicle lamp, of which FIG. 7A shows a low-beam light distribution pattern and FIG. 7B shows a high-beam light distribution pattern.

DETAILED DESCRIPTION OF EMBODIMENTS

Hereinbelow, by using the drawings, an embodiment of the invention of the application will be described.

Figure 1:
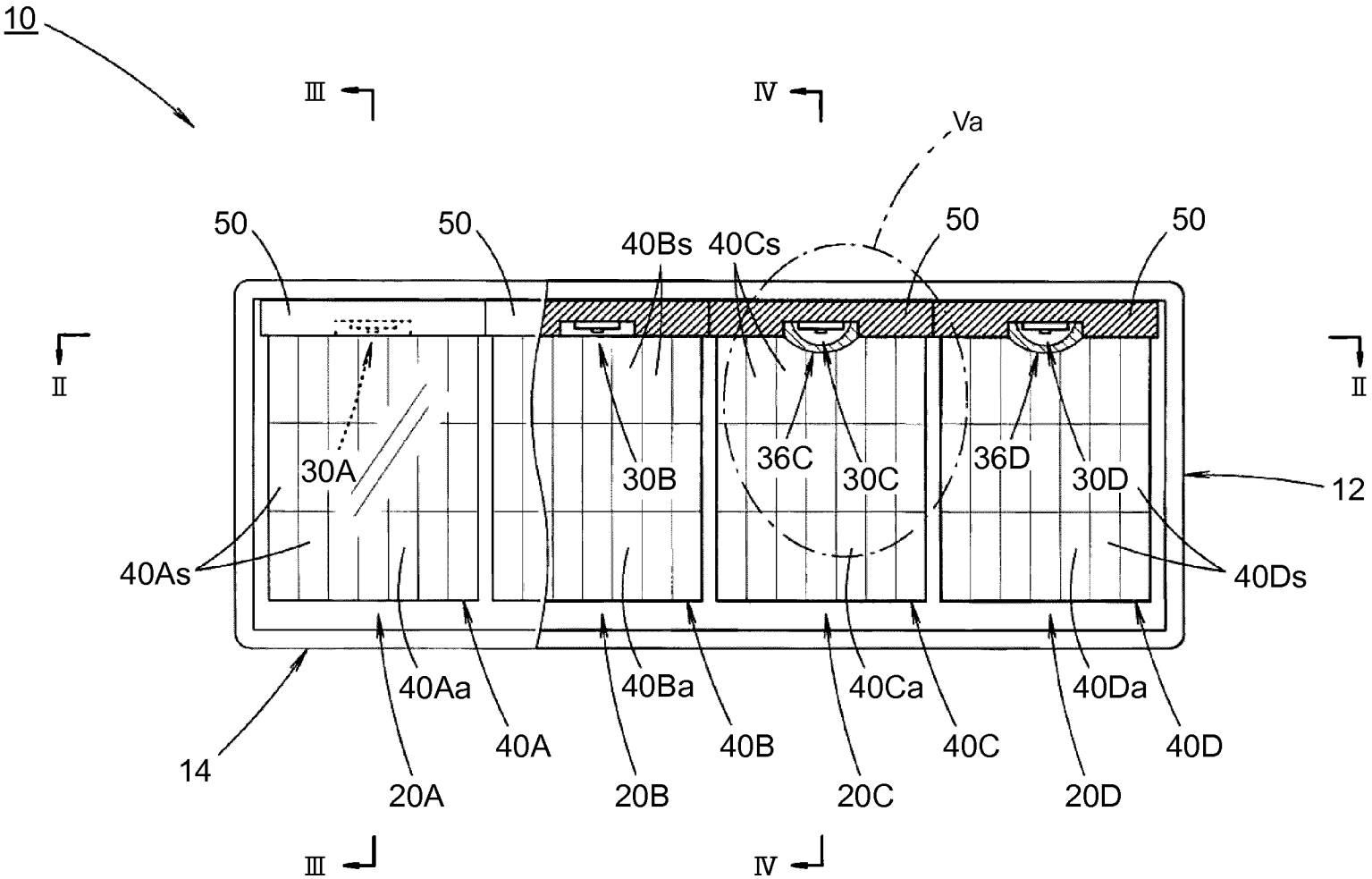
FIG. 1 is a front view showing a vehicle lamp according to an embodiment of the invention of the application.
Figure 2:
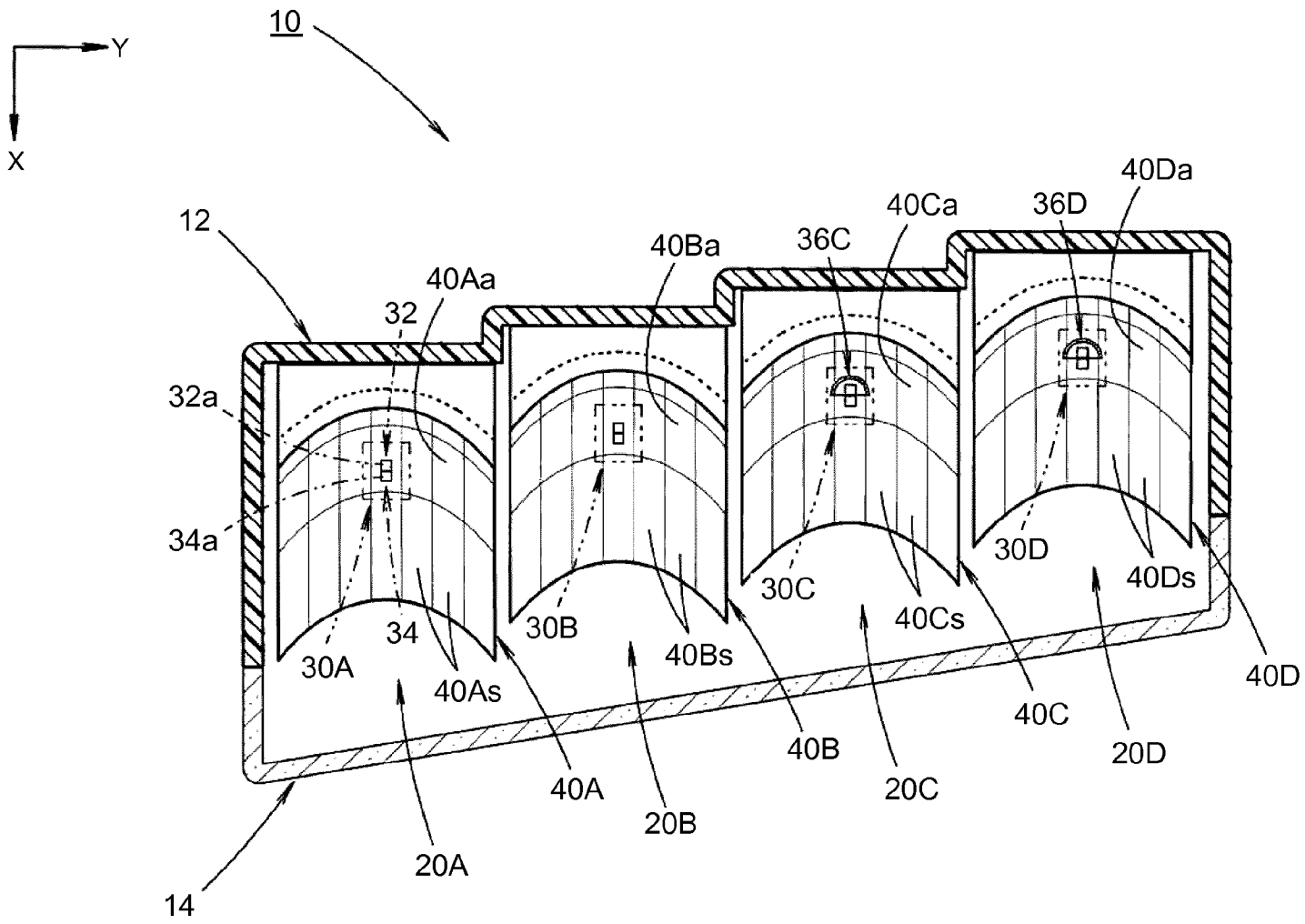
FIG. 2 is a sectional view taken along the line II-II of FIG. 1.
Figure 3:
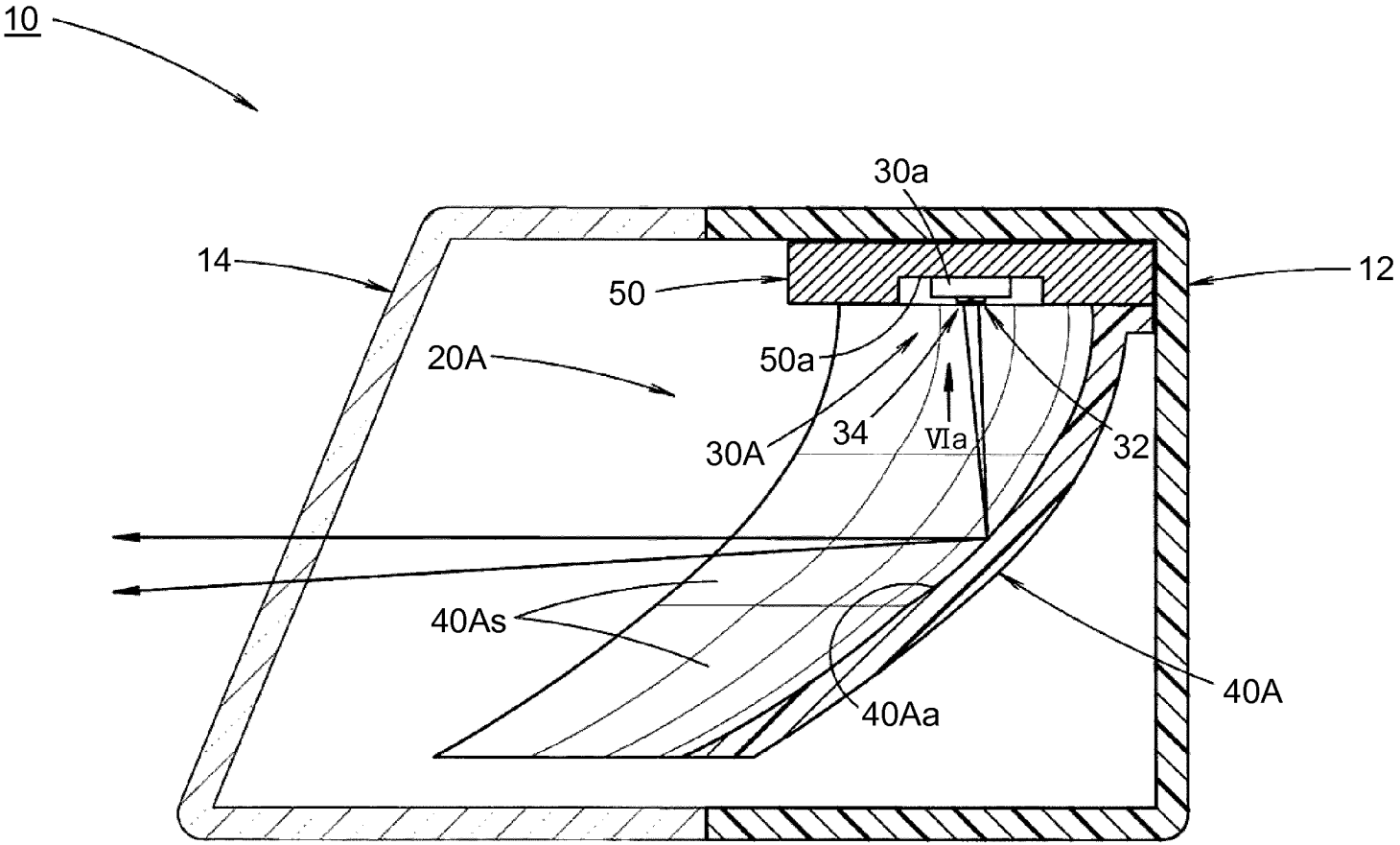
FIG. 3 is a sectional view taken along the line III-III of FIG. 1.
Figure 4:
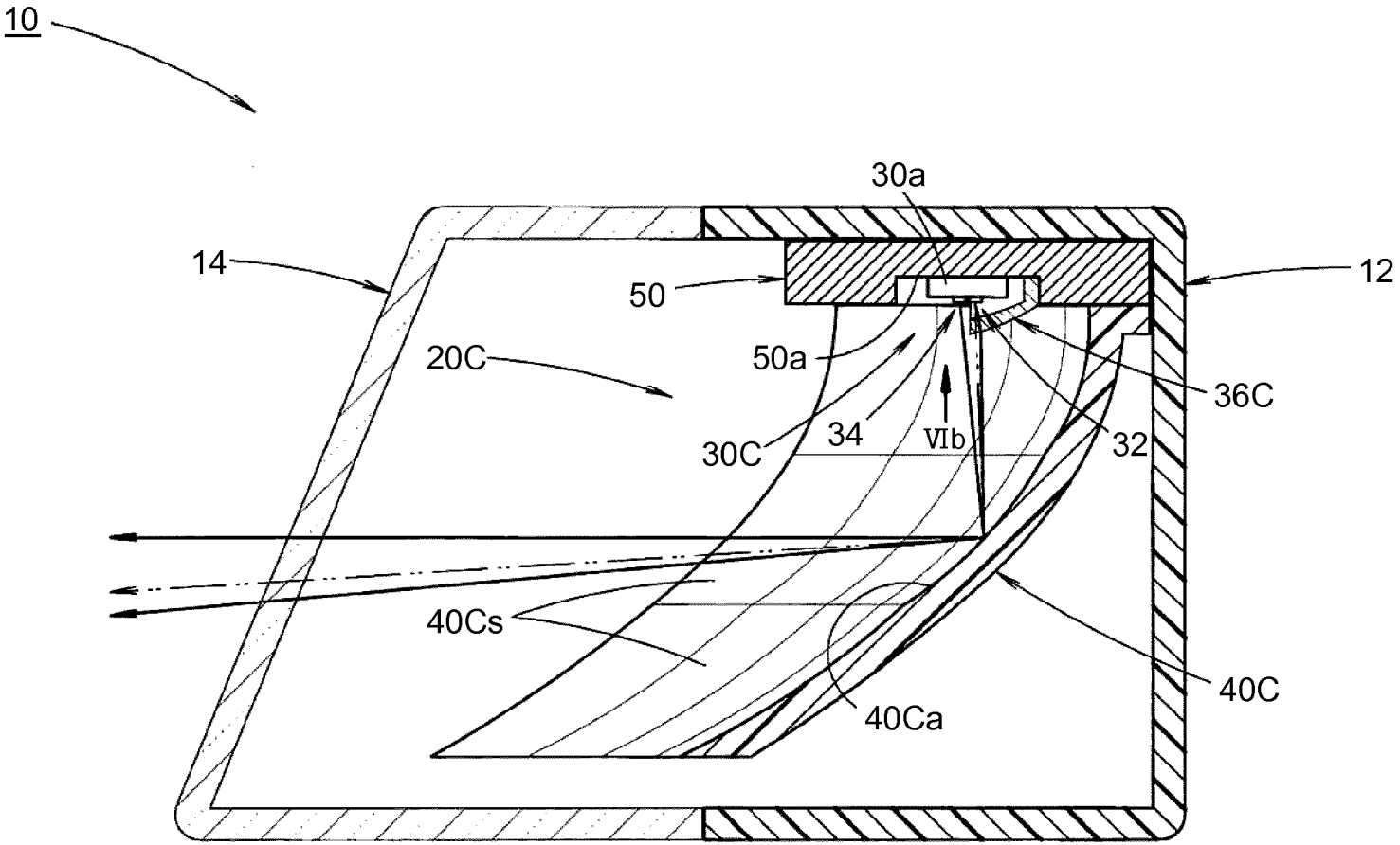
FIG. 4 is a sectional view taken along the line IV-IV of FIG. 1.

FIG. 1 is a front view showing a vehicle lamp 10 according to the embodiment of the invention of the application. FIG. 2 is a sectional view taken along the line II-II of FIG. 1, FIG. 3 is a sectional view taken along the line III-III of FIG. 1, and FIG. 4 is a sectional view taken along the line IV-IV of FIG. 1.

As shown in the drawings, the vehicle lamp 10 according to the embodiment is a headlamp disposed at a left front end portion of a vehicle, and is configured to selectively perform low beam irradiation and high beam irradiation.

For the vehicle lamp 10, a direction indicated by X in FIG. 2 is a "forward direction" (the "forward direction" for the vehicle), and a direction indicated by Y in FIG. 2 is a "left direction" orthogonal to the "forward direction" (the "left direction" for the vehicle but a "right direction" when the lamp is viewed from the front).

In the vehicle lamp 10, four reflector units 20A, 20B, 20C, and 20D are disposed in a lamp chamber formed of a lamp body 12 and a transparent light-transmitting cover 14 attached to an opening portion of a front end of the lamp body 12.

The four reflector units 20A, 20B, 20C, and 20D are disposed side by side in a vehicle width direction, and are disposed so as to be displaced farther to the rear with approach to an outer side in the vehicle width direction.

The reflector units 20A, 20B, 20C, and 20D include light emitting units 30A, 30B, 30C, and 30D, reflectors 40A, 40B, 40C, and 40D that reflect emitted light beams from the light emitting units 30A to 30D forward, and support members 50 that support the light emitting units 30A to 30D and the reflectors 40A to 40D.

The light emitting units 30A to 30D have the same configuration.

Each of the light emitting units 30A to 30D includes a first light emitting element 32 and a second light emitting element 34 disposed next to each other in a front-rear direction. The first and second light emitting elements 32 and 34 are disposed in a state in which light emitting surfaces 32*a* and 34*a* thereof face downward and the second light emitting element 34 is positioned forward of the first light emitting element 32.

Among the four reflector units 20A to 20D, in the two reflector units 20C and 20D positioned on the outer side in the vehicle width direction, diffusing lenses 36C and 36D that diffuse the emitted light beams from the first light emitting elements 32 in a right-left direction to cause the diffused light beams to enter the reflectors 40C and 40D.

In the embodiment, the first light emitting elements 32 of the reflector units 20A to 20D are simultaneously turned on in a low beam irradiation mode, and the second light emitting elements 34 of the reflector units 20A to 20D are simultaneously turned on in a high beam irradiation mode.

Next, the specific configuration of each of the light emitting units 30A to 30D in the reflector units 20A to 20D will be described.

Figure 5B:
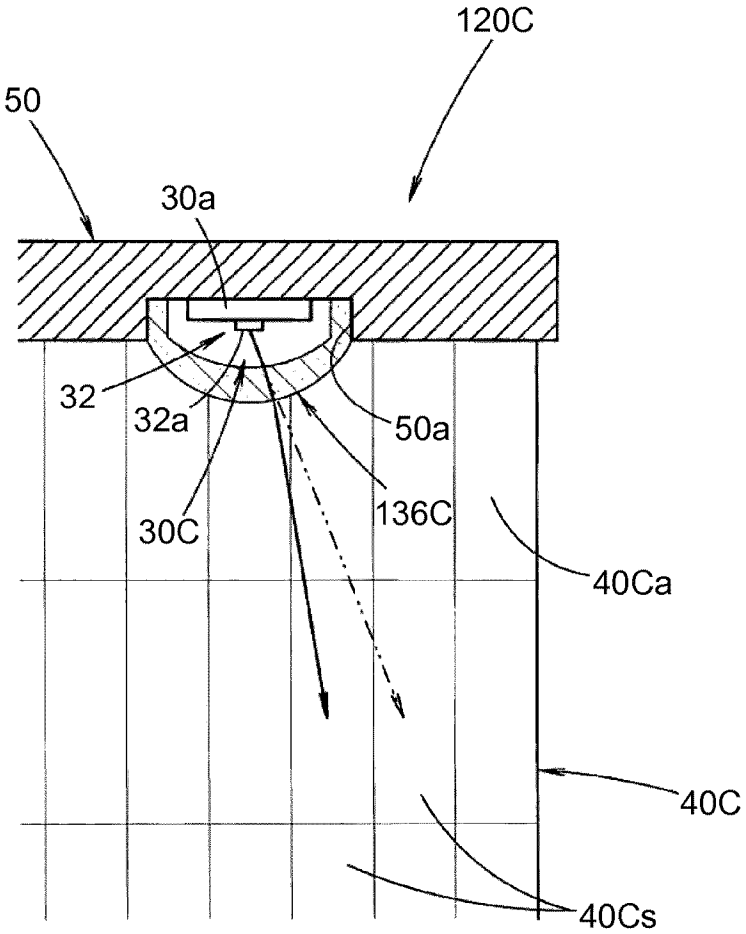
FIG. 5B is a view similar to FIG. 5A that shows a modification of the above embodiment.
Figure 5A:
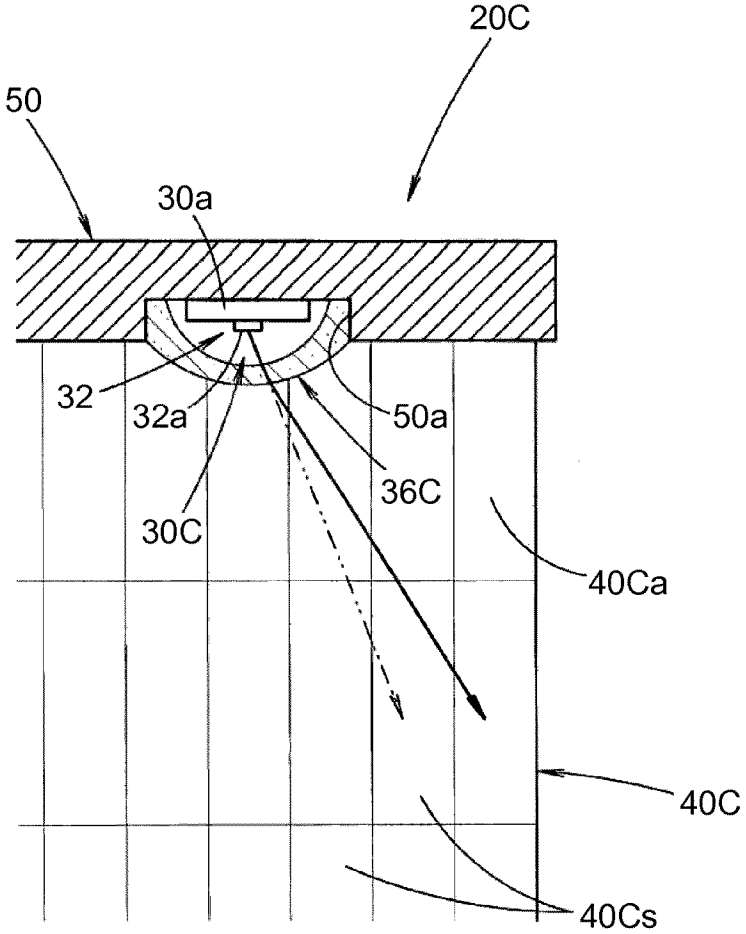
FIG. 5A is a detailed view of a Va portion of FIG. 1.
Figure 6B:
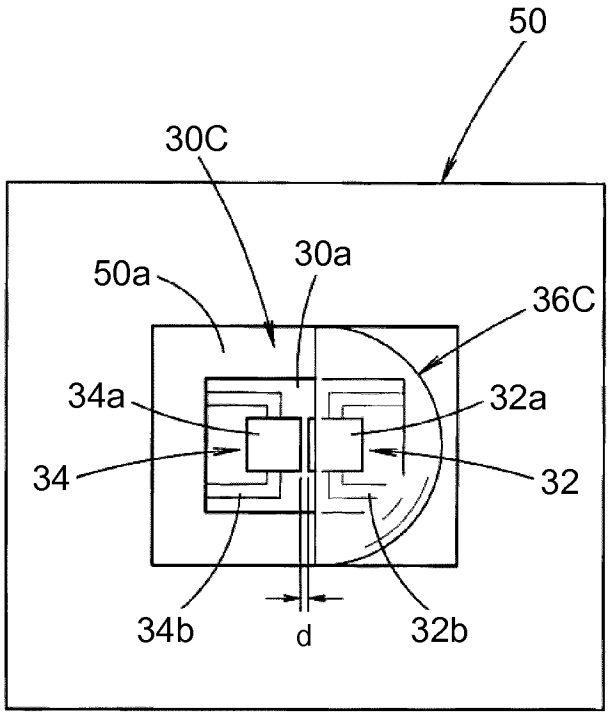
FIG. 6B is a detailed view taken in a direction of an arrow VIb of FIG. 4.
Figure 6A:
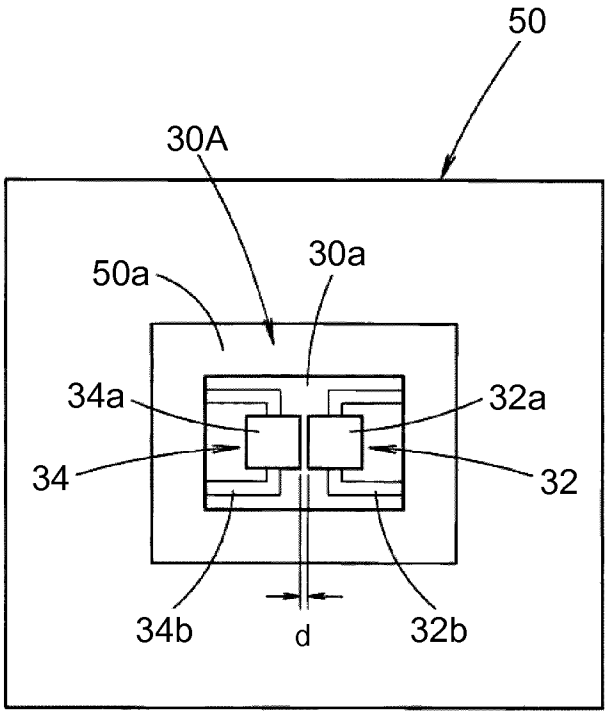
FIG. 6A is a detailed view taken in a direction of an arrow VIa of FIG. 3.

FIG. 5A is a detailed view of a Va portion of FIG. 1. FIG. 6A is a detailed view taken in a direction of an arrow VIa of FIG. 3, and FIG. 6B is a detailed view taken in a direction of an arrow VIb of FIG. 4.

As shown in these drawings, the first and second light emitting elements 32 and 34 are formed by mounting two light emitting chips on a common substrate 30*a*. Lower surfaces of the light emitting chips constitute light emitting surfaces 32*a* and 34*a*. Terminals 32*b* and 34*b* of the first and second light emitting elements 32 and 34 are connected in parallel to a lighting control circuit that is not shown.

The light emitting surface 32*a* of the first light emitting element 32 and the light emitting surface 34*a* of the second light emitting element 34 have the same outer shape. Specifically, each of the light emitting surfaces 32*a* and 34*a* has a square outer shape having each side of about 1 mm, and is disposed in a state in which four sides are directed in the front-rear direction and the right-left direction. A distance d between the light emitting surfaces 32*a* and 34*a* is set to a value equal to or smaller than 0.3 mm (e.g., about 0.15 mm).

Lower surfaces of the support members 50 of the reflector units 20A to 20D has concave portions 50*a*, and the light emitting units 30A to 30D are disposed in the concave portions 50*a*. The support member 50 is formed of a metal member, and functions as a heat sink that dissipates heat generated by the first and second light emitting elements 32 and 34.

In the two reflector units 20C and 20D, the diffusing lenses 36C and 36D are supported by the support members 50.

The vertical cross-sectional shape of each of the diffusing lenses 36C and 36D along the vehicle width direction is formed into the shape of a concave meniscus lens, and the emitted light beam from the first light emitting element 32 is thereby diffused in the right-left direction. The diffusing lens 36D of the reflector unit 20D has an optical power larger than that of the diffusing lens 36C of the reflector unit 20C, and diffuses the emitted light beam from the first light emitting element 32 in the right-left direction more widely than the diffusing lens 36C of the reflector unit 20C.

The vertical cross-sectional shape of each of the diffusing lenses 36C and 36D along the front-rear direction is set to a shape in which the thickness thereof is gradually reduced with approach to the rear, and the emitted light beam from the first light emitting element 32 is thereby deflected in a downward direction.

Next, the specific configuration of each of the reflectors 40A to 40D in the reflector units 20A to 20D will be described.

The reflectors 40A and 40B of the reflector units 20A and 20B have a configuration suitable for the low beam irradiation. On the other hand, the reflectors 40C and 40D of the reflector units 20C and 20D have a configuration suitable for the high beam irradiation.

The reflector 40A includes a reflective surface 40Aa formed with reference to the front end position of the light emitting surface 32*a* of the first light emitting element 32. The reflective surface 40Aa is formed of a plurality of reflective elements 40As. The emitted light beam from the first light emitting element 32 (or the second light emitting element 34) is reflected at the reflective elements 40As to be deflected or diffused in the horizontal direction or an oblique direction inclined relative to a horizontal plane.

The reflector 40B also includes a reflective surface 40Ba formed with reference to the front end position of the light emitting surface 32*a* of the first light emitting element 32. The reflective surface 40Ba is formed of a plurality of reflective elements 40Bs. The emitted light beam from the first light emitting element 32 (or the second light emitting element 34) is reflected at the reflective elements 40Bs to be diffused in the horizontal direction.

On the other hand, the reflector 40C includes a reflective surface 40Ca formed with reference to the center position of the light emitting surface 34*a* of the second light emitting element 34. The reflective surface 40Ca is formed of a plurality of reflective elements 40Cs. The emitted light beam from the second light emitting element 34 (or the first light emitting element 32) is reflected at the reflective elements 40Cs to be slightly diffused in the horizontal direction.

At this point, the emitted light beam from the first light emitting element 32 is diffused in the right-left direction by the diffusing lens 36C and enters the reflective surface 40Ca of the reflector 40C as the diffused light beam. Hence, the light beam is reflected at the reflective elements 40Cs as the light beam that is diffused in the horizontal direction and is deflected downward.

The reflector 40D also includes a reflective surface 40Da formed with reference to the center position of the light emitting surface 34*a* of the second light emitting element 34. The reflective surface 40Da is formed of a plurality of reflective elements 40Ds. The emitted light beam from the second light emitting element 34 (or the first light emitting element 32) is reflected at the reflective elements 40Ds to be diffused slightly in the horizontal direction.

At this point, the emitted light beam from the first light emitting element 32 is diffused in the right-left direction by the diffusing lens 36D and enters the reflective surface 40Da of the reflector 40D as the diffused light beam. Hence, the light beam is reflected at the reflective elements 40Ds as the light beam that is diffused in the horizontal direction and is deflected downward.

Figure 7A:
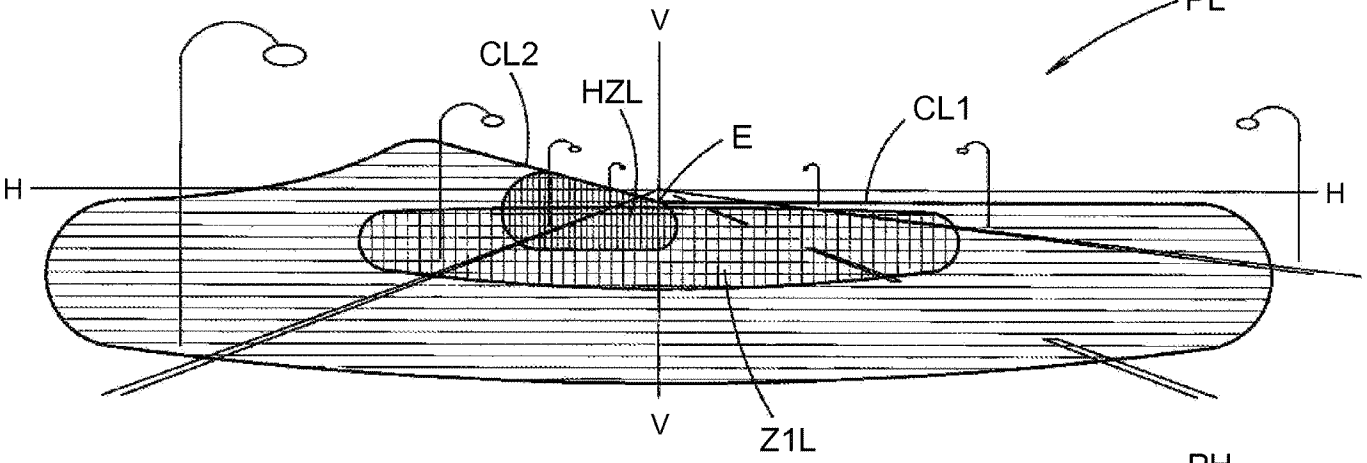
Figure 7B:
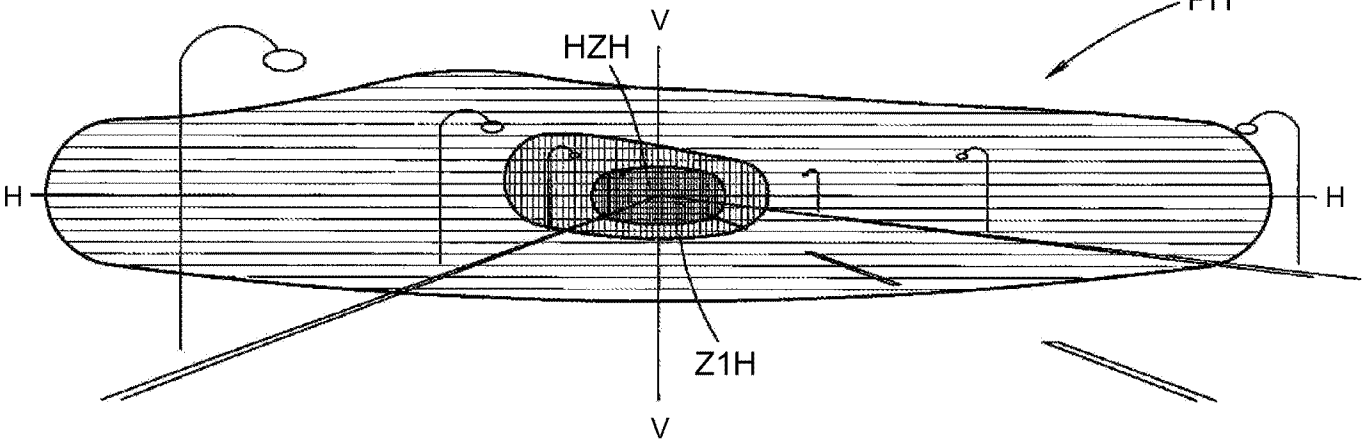

FIGS. 7A and 7B are perspective views showing light distribution patterns formed on a virtual vertical screen disposed at a position 25 m forward of the lamp by the light beam projected forward from the vehicle lamp 10. The light distribution pattern shown in FIG. 7A is a low-beam light distribution pattern, and the light distribution pattern shown in FIG. 7B is a high-beam light distribution pattern.

A low-beam light distribution pattern PL shown in FIG. 7A is a low-beam light distribution pattern of left light distribution, and has a horizontal cut-off line CL1 and an oblique cut-off line CL2 at its upper end edge. The horizontal cut-off line CL1 is formed in an opposite lane-side portion on the right side of a V-V line that vertically passes through a vanishing point H-V in the forward direction of the lamp, and the oblique cut-off line CL2 is formed in a driving lane-side portion on the left side of the V-V line.

In the low-beam light distribution pattern PL, an elbow point E as a point of intersection between the horizontal cut-off line CL1 and the oblique cut-off line CL2 is positioned about 0.5° to 0.6° below the vanishing point H-V. In the low-beam light distribution pattern PL, a high luminous intensity area (i.e., a hot zone) HZL is positioned on the left of and below the elbow point E, and a middle diffusion area Z1L extending laterally is formed in the vicinity of a portion below the elbow point E. The middle diffusion area Z1L reinforces brightness around the high luminous intensity area HZL.

The low-beam light distribution pattern PL is formed as a combination light distribution pattern of four light distribution patterns PLa, PLb, PLc, and PLd shown in FIGS. 8A, 8C, 8E, and 8G.

Figure 8A:
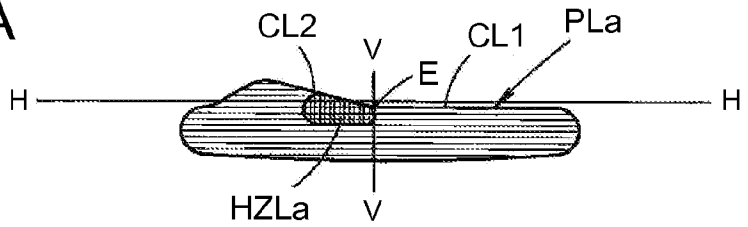
FIGS. 8A to 8H are views illustrating the low-beam light distribution pattern and the high-beam light distribution pattern by showing a plurality of light distribution patterns constituting the low-beam light distribution pattern and the high-beam light distribution pattern.

The light distribution pattern PLa shown in FIG. 8A is the light distribution pattern formed by the irradiation light beam from the reflector unit 20A.

The light distribution pattern PLa is the light distribution pattern that forms the principal portion of the low-beam light distribution pattern PL. The horizontal and oblique cut-off lines CL1 and CL2 are formed by the light distribution pattern PLa, and most of the high luminous intensity area HZL of the low-beam light distribution pattern PL is formed by its high luminous intensity area HZLa.

Figure 8B:
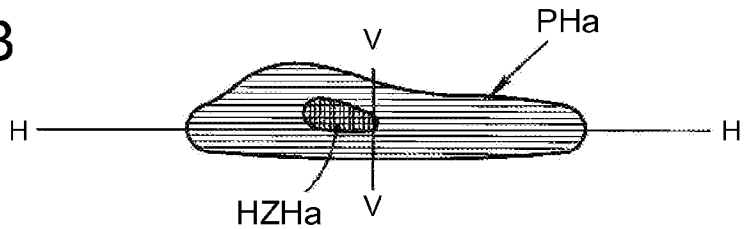
Figure 8C:
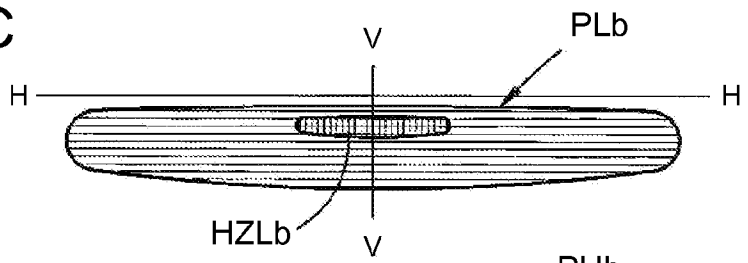

The light distribution pattern PLb shown in FIG. 8C is the light distribution pattern formed by the irradiation light beam from the reflector unit 20B.

The light distribution pattern PLb is the light distribution pattern that forms the diffusion area of the low-beam light distribution pattern PL, and its high luminous intensity area HZLb is positioned close to the upper end edge of the light distribution pattern PLb.

Figure 8D:
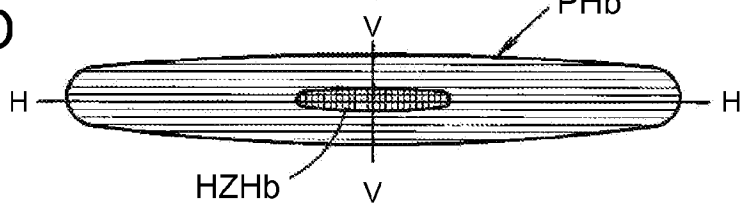
Figure 8E:
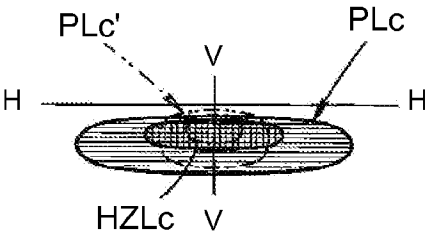

The light distribution pattern PLc shown in FIG. 8E is the light distribution pattern formed by the irradiation light beam from the reflector unit 20C.

The light distribution pattern PLc is the oblong light distribution pattern that spreads in the horizontal direction to a certain degree below the elbow point E, and forms part of the middle diffusion area Z1L of the low-beam light distribution pattern PL. A high luminous intensity area HZLc of the light distribution pattern PLc is positioned close to the upper end edge of the light distribution pattern PLc.

A light distribution pattern PLc' indicated by a two-dot chain line in FIG. 8E is the light distribution pattern formed in the case where the diffusing lens 36C is not present, and is formed into a spot shape at a position slightly displaced upward from the position of the light distribution pattern PLc. However, the diffusing lens 36C is actually present, and hence the emitted light beam from the first light emitting element 32 is diffused so as to be directed slightly downward in the right-left direction and enters the reflector 40C as the diffused light beam. As a result, the light distribution pattern PLc is the light distribution pattern obtained by displacing the light distribution pattern PLc' downward and spreading the light distribution pattern PLc' in the horizontal direction.

Figure 8F:
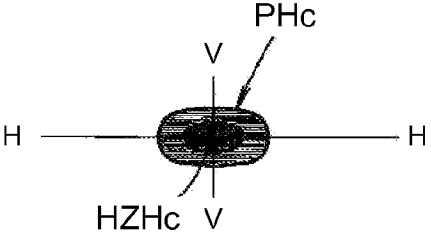
Figure 8G:
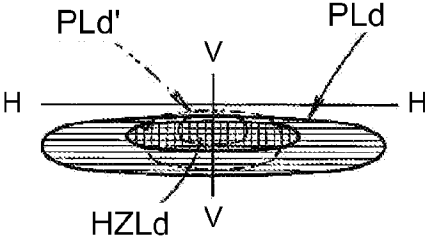

The light distribution pattern PLd shown in FIG. 8G is the light distribution pattern formed by the irradiation light beam from the reflector unit 20D.

The light distribution pattern PLd is the oblong light distribution pattern that spreads slightly widely in the horizontal direction below the elbow point E, and forms part of the middle diffusion area Z1L of the low-beam light distribution pattern PL. A high luminous intensity area HZLd of the light distribution pattern PLd is positioned close to the upper end edge of the light distribution pattern PLd.

A light distribution pattern PLd' indicated by a two-dot chain line in FIG. 8G is the light distribution pattern formed in the case where the diffusing lens 36D is not present, and is formed into a generally spot shape at a position slightly displaced upward from the position of the light distribution pattern PLd. However, the diffusing lens 36D is actually present, and hence the emitted light beam from the first light emitting element 32 is diffused so as to be directed slightly downward in the right-left direction and enters the reflector 40D as the diffused light beam. As a result, the light distribution pattern PLd is formed as the light distribution pattern obtained by displacing the light distribution pattern PLd' downward and spreading the light distribution pattern PLd' in the horizontal direction.

On the other hand, a high-beam light distribution pattern PH shown in FIG. 7B is formed as an oblong light distribution pattern that spreads to the left and the right with the vanishing point H-V positioned at its center.

In the high-beam light distribution pattern PH, its high luminous intensity area HZH is formed extends slightly laterally with the vanishing point H-V positioned at its center, and a small diffusion area Z1H elongated more on its left side is formed around the high luminous intensity area HZH. The small diffusion area Z1H reinforces brightness around the high luminous intensity area HZH.

The high-beam light distribution pattern PH is formed as a combination light distribution pattern of four light distribution patterns PHa, PHb, PHc, and PHd shown in FIGS. 8B, 8D, 8F, and 8H.

The light distribution pattern PHa shown in FIG. 8B is the light distribution pattern formed by the irradiation light beam from the reflector unit 20A.

The light distribution pattern PHa is the light distribution pattern formed as a result of constituting the reflector unit 20A such that the light distribution pattern PLa of the low-beam light distribution pattern PL is formed. The light distribution pattern PHa is the light distribution pattern obtained by displacing the light distribution pattern PLa upward and deforming the outer shape thereof.

The light distribution pattern PHa is displaced upward from the position of the light distribution pattern PLa because the orientation of the reflected light beam from the reflector 40A of the emitted light beam from the second light emitting element 34 disposed forward of the first light emitting element 32 is more upward than that of the emitted light beam from the first light emitting element 32.

A high luminous intensity area HZHa of the light distribution pattern PHa is displaced upward from the position of the high luminous intensity area HZLa of the light distribution pattern PLa, but the displacement amount thereof is smaller than the upward displacement amount of the light distribution pattern PHa relative to the light distribution pattern PLa. The high luminous intensity area HZHa is positioned in the vicinity of the center of the light distribution pattern PHa in a vertical direction.

The light distribution pattern PHb shown in FIG. 8D is the light distribution pattern formed by the irradiation light beam from the reflector unit 20B.

The light distribution pattern PHb is the light distribution pattern that forms the diffusion area of the high-beam light distribution pattern PH, and has a shape obtained by displacing the light distribution pattern PLb of the low-beam light distribution pattern PL upward.

A high luminous intensity area HZHb of the light distribution pattern PHb is positioned in the vicinity of the center of the light distribution pattern PHb in the vertical direction.

The light distribution pattern PHc shown in FIG. 8F is the light distribution pattern formed by the irradiation light beam from the reflector unit 20C.

The light distribution pattern PHc is the spot-shaped light distribution pattern that slightly spreads in the horizontal direction with the vanishing point H-V positioned at its center, and forms the principal portion of the high luminous intensity area HZH of the high-beam light distribution pattern PH. A high luminous intensity area HZHc of the light distribution pattern PHc is positioned at the vanishing point H-V.

Figure 8H:
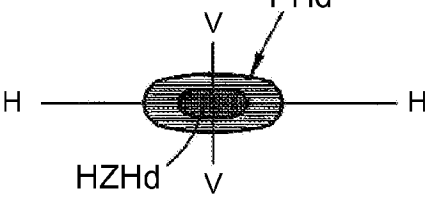

The light distribution pattern PHd shown in FIG. 8H is the light distribution pattern formed by the irradiation light beam from the reflector unit 20D.

The light distribution pattern PHd is the light distribution pattern that narrowly spreads in the horizontal direction with the vanishing point H-V positioned at its center, and forms part of the high luminous intensity area HZH of the high-beam light distribution pattern PH. A high luminous intensity area HZHd of the light distribution pattern PHd is positioned at the vanishing point H-V.

Next, the operation and effect of the embodiment will be described.

The vehicle lamp 10 according to the embodiment forms the low-beam light distribution pattern PL by simultaneously turning on the first light emitting elements 32 of the four reflector units 20A, 20B, 20C, and 20D, and form the high-beam light distribution pattern PH by simultaneously turning on the second light emitting elements 34 thereof. Hence, as compared with the conventional configuration in which a plurality of reflectors for the low beam irradiation and a plurality of reflectors for the high beam irradiation are disposed, it is possible to reduce the number of required reflector units and thereby reduce the size of the vehicle lamp 10.

Thus, according to the embodiment, in the vehicle lamp 10 configured to selectively perform the low beam irradiation and the high beam irradiation by reflecting the light beam from the light emitting element forward using the reflector, it is possible to form desired light distribution patterns with a compact configuration.

In addition, by adopting the configuration of the embodiment, it becomes possible to achieve a reduction in cost by the reduction in the number of required reflector units.

Further, in the embodiment, since the first and second light emitting elements 32 and 34 of the reflector units 20A to 20D are disposed in a state in which the light emitting surfaces 32*a* and 34*a* face downward and the second light emitting elements 34 are positioned forward of the first light emitting elements 32, it is possible to prevent a direct light beam from the first light emitting element 32 from being projected obliquely upward and forward. With this, it is possible to prevent the occurrence of glare light.

In addition, since the two reflector units 20C and 20D include the diffusing lenses 36C and 36D that diffuses the emitted light beams from the first light emitting elements 32 in the right-left direction to cause the diffused light beams to enter the reflectors 40C and 40D, it is possible to obtain the following operation and effect.

The two reflector units 20C and 20D form the spot-shaped light distribution patterns PHc and PHd by turning on the second light emitting elements 34 to thereby form the high luminous intensity area HZH of the high-beam light distribution pattern PH. In the case where the reflector units 20C and 20D do not include the diffusing lenses 36C and 36D, when the first light emitting elements 32 are turned on, the spot-shaped light distribution patterns PLc' and PLd' are formed in the low-beam light distribution pattern, and a high luminous intensity area is thereby formed below the formation position of the high luminous intensity area HZH. However, there is a possibility that the high luminous intensity area becomes extremely bright as the low-beam light distribution pattern PL and light unevenness occurs in the low-beam light distribution pattern PL.

In contrast to this, as in the embodiment, by using the diffusing lenses 36C and 36D and diffusing the emitted light beams from the first light emitting elements 32 in the right-left direction to cause the diffused light beams to enter the reflectors 40C and 40D, it is possible to form the light distribution patterns PHc and PHd that spread in the horizontal direction by using the reflected light beams from the reflectors 40C and 40D. With this, it is possible to prevent the high luminous intensity area HZL of the low-beam light distribution pattern PL from becoming extremely bright to thereby cause the light unevenness in the low-beam light distribution pattern PL.

Moreover, since the diffusing lenses 36C and 36D of the reflector units 20C and 20D deflect the emitted light beams from the first light emitting elements 32 slightly downward to cause the deflected light beams to enter the reflectors 40C and 40D, it is possible to prevent the light distribution patterns PHc and PHd formed by using the reflected light beams from the reflectors 40C and 40D from accidentally protruding above the horizontal cut-off line CL1 and the oblique cut-off line CL2.

In the embodiment, since the distance d between the light emitting surface 32*a* of the first light emitting element 32 and the light emitting surface 34*a* of the second light emitting element 34 is set to a value of about 0.15 mm (i.e., a value equal to or smaller than 0.3 mm) in each of the reflector units 20A to 20D, it is possible to obtain the following operation and effect.

The light distribution patterns PHa, PHb, PHc, and PHd formed by turning on the second light emitting element 34 are displaced upward relative to the light distribution patterns PLa, PLb, PLc, and PLd formed by turning on the first light emitting element 32. In the case where the distance d between the light emitting surface 32*a* of the first light emitting element 32 and the light emitting surface 34*a* of the second light emitting element 34 is extremely long, when the light distribution patterns PLa and PLb formed by turning on the first light emitting element 32 are formed at positions suitable for the formation of the low-beam light distribution pattern PL, the light distribution patterns PHa and PHb formed by turning on the second light emitting element 34 are formed at positions displaced upward from positions suitable for the formation of the high-beam light distribution pattern PH.

In contrast to this, when the distance d between the light emitting surface 32*a* of the first light emitting element 32 and the light emitting surface 34*a* of the second light emitting element 34 is set to a low value equal to or smaller than 0.3 mm, it is possible to form the light distribution patterns PLa and PLb formed by turning on the first light emitting element 32 at the positions suitable for the formation of the low-beam light distribution pattern PL and then form the light distribution patterns PHa and PHb formed by turning on the second light emitting element 34 at the positions suitable for the formation of the high-beam light distribution pattern PH.

In the embodiment, since the first and second light emitting elements 32 and 34 are formed by mounting two light emitting chips on the common substrate 30*a*, and the lower surfaces of the light emitting chips constitute the light emitting surfaces 32*a* and 34*a*, setting of the distance d between the light emitting surfaces 32*a* and 34*a* to a value equal to or smaller than 0.3 mm is easily allowed.

Even in the case where the width of the light emitting surface 34*a* of the second light emitting element 34 in the front-rear direction and the size of each of the reflectors 40A to 40D are larger than those in the embodiment, and the distance d between the light emitting surface 32*a* of the first light emitting element 32 and the light emitting surface 34*a* of the second light emitting element 34 is set to a value larger than 0.3 mm, when the distance d is set to a value equal to or smaller than ⅕ of the width of the light emitting surface 34*a* of the second light emitting element 34 in the front-rear direction, it is possible to form the light distribution patterns PHa and PHb formed by turning on the second light emitting element 34 at the positions suitable for the formation of the high-beam light distribution pattern PH.

Although the above embodiment has the configuration that includes the four reflector units 20A to 20D, it is possible to adopt a configuration that includes three or less or five or more reflector units, and it is also possible to adopt a configuration that includes another reflector unit in addition to the four reflector units 20A to 20D, and forms the low-beam light distribution pattern PL or the high-beam light distribution pattern PH by additionally turning on the light emitting element.

In the above embodiment, the description has been given on the configuration in which the first and second light emitting elements 32 and 34 of the reflector units 20A to 20D are disposed in the state in which the light emitting surfaces 32*a* and 34*a* face downward and the second light emitting elements 34 are positioned forward of the first light emitting elements 32, but it is possible to obtain substantially the same operation and effect as those of the above embodiment also in the case where the first and second light emitting elements 32 and 34 are disposed in a state in which the light emitting surfaces 32*a* and 34*a* face upward and the second light emitting elements 34 are positioned rearward of the first light emitting elements 32.

In the above embodiment, the description has been given on the configuration in which the light emitting surface 32*a* of the first light emitting element 32 and the light emitting surface 34*a* of the second light emitting element 34 have the same outer shape, but it is also possible to adopt a configuration in which the light emitting surface 32*a* and the light emitting surface 34*a* have different outer shapes. In addition, it is also possible to adopt outer shapes other than the square shape as the outer shapes of the light emitting surfaces 32*a* and 34*a*.

In the above embodiment, the description has been given on the configuration in which the first and second light emitting elements 32 and 34 are formed by mounting two light emitting chips on the common substrate 30*a*, but it is also possible to form the first and second light emitting elements by mounting the light emitting chips on separate substrates.

In the above embodiment, the description has been given on the configuration in which the diffusing lens having the vertical cross-sectional shape along the vehicle width direction that is formed into the shape of the concave meniscus lens is used as the diffusing lens 36C of the reflector unit 20C (or the diffusing lens 36D of the reflector unit 20D) but, as a diffusing lens 136C of a reflector unit 120C shown in FIG. 5B, it is also possible to use a diffusing lens having the vertical cross-sectional shape along the vehicle width direction that is formed into the shape of a convex meniscus lens.

In this case as well, it is possible to diffuse the emitted light beam from the first light emitting element 32 in the right-left direction to cause the diffused light beams to enter the reflector 40C. In addition, by adopting the above configuration, it becomes possible to cause a more emitted light beam from the first light emitting element 32 to enter the reflector 40C.

In the above embodiment, the description has been given on the vehicle lamp 10 configured to form the low-beam light distribution pattern PL of the left light distribution but, by adopting a configuration in which the vehicle lamp 10 according to the embodiment is laterally inverted, it is also possible to configure the vehicle lamp 10 such that the low-beam light distribution pattern for right light distribution is formed.

Note that the numeric values shown as the specifications of the vehicle lamp in the embodiment and the modification are only examples and these numeric values may be set to different values as required.

In addition, the invention is not limited to the configuration described in the above embodiment, and the embodiment of the invention may adopt a configuration in which other various changes are made.

As described above, the vehicle lamp according to the invention is configured to selectively perform low beam irradiation and high beam irradiation, and includes at least two reflector units each including a first light emitting element and a second light emitting element disposed next to each other in a front-rear direction and a reflector that reflects emitted light beams from the first light emitting element and the second light emitting element forward. In the vehicle lamp, a low-beam light distribution pattern or part of the low-beam light distribution pattern is formed by simultaneously turning on the first light emitting element of each of the reflector units, and a high-beam light distribution pattern or part of the high-beam light distribution pattern is formed by simultaneously turning on the second light emitting element of each of the reflector units.

The types of the first light emitting element and the second light emitting element are not particularly limited, and it is possible to use, e.g., a light emitting diode and a laser diode.

The specific positional relationship between the at least two reflector units is not particularly limited.

Forming the low-beam light distribution pattern or the part of the low-beam light distribution pattern includes forming the low-beam light distribution pattern only by simultaneously turning on the first light emitting element of each of the reflector units, and forming the low-beam light distribution pattern by providing another reflector unit and additionally turning on the light emitting element thereof.

Forming the high-beam light distribution pattern or the part of the high-beam light distribution pattern includes forming the high-beam light distribution pattern only by simultaneously turning on the second light emitting element of each of the reflector units, and forming the high-beam light distribution pattern by providing another reflector unit and additionally turning on the light emitting element thereof.

What is claimed is:

1. A vehicle lamp configured to selectively perform low beam irradiation and high beam irradiation, the vehicle lamp comprising:

at least two reflector units each including a first light emitting element and a second light emitting element disposed next to each other in a front-rear direction and a reflector that reflects emitted light beams from the first light emitting element and the second light emitting element forward, wherein a low-beam light distribution pattern or part of the low-beam light distribution pattern is formed by simultaneously turning on the first light emitting element of each of the reflector units, and a high-beam light distribution pattern or part of the high-beam light distribution pattern is formed by simultaneously turning on the second light emitting element of each of the reflector units, wherein at least one of the at least two reflector units includes a diffusing lens that diffuses light beam emitted from the first light emitting element of the reflector unit in a right-left direction to cause light beam after diffusion to enter the reflector of the reflector unit.

2. A vehicle lamp configured to selectively perform low beam irradiation and high beam irradiation, the vehicle lamp comprising:

at least two reflector units each including a first light emitting element and a second light emitting element disposed next to each other in a front-rear direction and a reflector that reflects emitted light beams from the first light emitting element and the second light emitting element forward, wherein a low-beam light distribution pattern or part of the low-beam light distribution pattern is formed by simultaneously turning on the first light emitting element of each of the reflector units, and a high-beam light distribution pattern or part of the high-beam light distribution pattern is formed by simultaneously turning on the second light emitting element of each of the reflector units, wherein a distance between a light emitting surface of the first light emitting element and a light emitting surface of the second light emitting element is set to a value equal to or smaller than 0.3 mm in each of the reflector units.

3. A vehicle lamp configured to selectively perform low beam irradiation and high beam irradiation, the vehicle lamp comprising:

at least two reflector units each including a first light emitting element and a second light emitting element disposed next to each other in a front-rear direction and a reflector that reflects emitted light beams from the first light emitting element and the second light emitting element forward, wherein a low-beam light distribution pattern or part of the low-beam light distribution pattern is formed by simultaneously turning on the first light emitting element of each of the reflector units, and a high-beam light distribution pattern or part of the high-beam light distribution pattern is formed by simultaneously turning on the second light emitting element of each of the reflector units, wherein a distance between a light emitting surface of the first light emitting element and a light emitting surface of the second light emitting element is set to a value equal to or smaller than ⅕ of a width of the light emitting surface of the second light emitting element in the front-rear direction in each of the reflector units.

* * * * *